United States Patent [19]

Fales et al.

[11] 4,254,866

[45] Mar. 10, 1981

[54] KNOCK-DOWN FLOOR LAMP

[75] Inventors: Gene T. Fales, Greensboro; James R. Mullins, Burlington, both of N.C.

[73] Assignee: Dunning Industries, Inc., Greensboro, N.C.

[21] Appl. No.: 49,409

[22] Filed: Jun. 18, 1979

[51] Int. Cl.[3] ..... B65D 85/00; B65D 85/42; B65D 77/04

[52] U.S. Cl. ..... 206/320; 206/326; 206/588; 206/593

[58] Field of Search ..... 206/320, 326, 593, 521, 206/588, 525, 45.19, 578

[56] References Cited

U.S. PATENT DOCUMENTS

| | | | |
|---|---|---|---|
| 1,936,616 | 11/1933 | Boye | 248/159 |
| 2,308,567 | 1/1943 | Reichart | 206/320 |
| 2,418,067 | 3/1947 | Carpenter, Sr. | 206/578 |
| 2,521,355 | 9/1950 | Ford | 248/159 |
| 2,708,324 | 5/1955 | Wedden | 211/196 |
| 3,142,446 | 7/1964 | Okamoto | 206/320 |
| 3,373,964 | 3/1968 | Bunders | 248/158 |
| 3,745,331 | 7/1973 | Dennis | 362/414 |
| 3,871,520 | 3/1975 | Hand | 206/320 |
| 4,068,119 | 1/1978 | Audet | 362/414 |
| 4,189,051 | 2/1980 | Fales et al. | 206/326 |

*Primary Examiner*—William T. Dixson, Jr.

*Attorney, Agent, or Firm*—Cushman, Darby & Cushman

[57] ABSTRACT

A knock-down floor lamp that is shipped prewired and unassembled in a package, and then can be readily assembled by the ultimate consumer with simple tools and without twisting of the electrical prewiring. First and second elongated tubular turnings are provided, the first turning having a socket formed at a first end thereof, and the second turning being releasably connectable to a lamp base at a first end thereof. A tray is disposed between the turnings, and they are connected together, sandwiching the tray therebetween, with structure that does not require rotational movement of one turning with respect to the other. Preferably a first plate having three screw threaded rods extending therefrom is attached to the first turning and passes through bores in the tray and in a second plate attached to the second turning, nuts being disposed on the end of the threaded rods to hold the turnings in place. An electrical cord having a length significantly longer than the sum of the lengths of the turnings and a cord passageway in the base, is connected to the socket at a first end thereof and has a plug at the second end thereof, and extends through the turnings, tray and base. In the unassembled position, a layering is provided within a carton, the layering including the turnings, a cardboard sheet, the tray, another cardboard sheet, and the base, with thin film plastic holding all of the components together. A shade may be packaged in the same carton.

18 Claims, 6 Drawing Figures

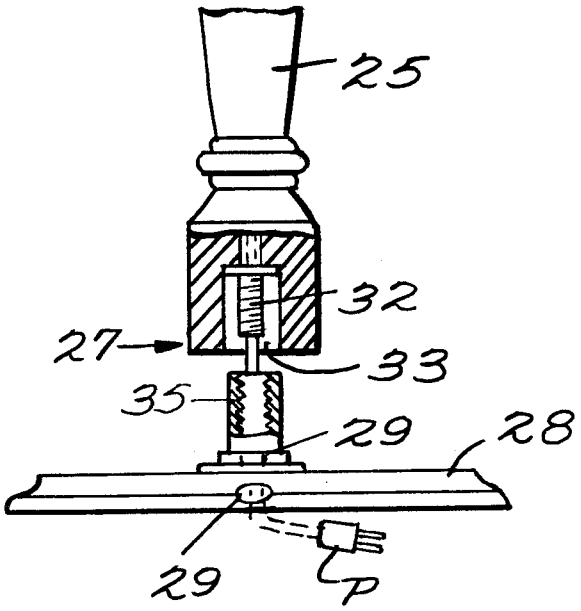
Fig. 5.
Fig. 6.
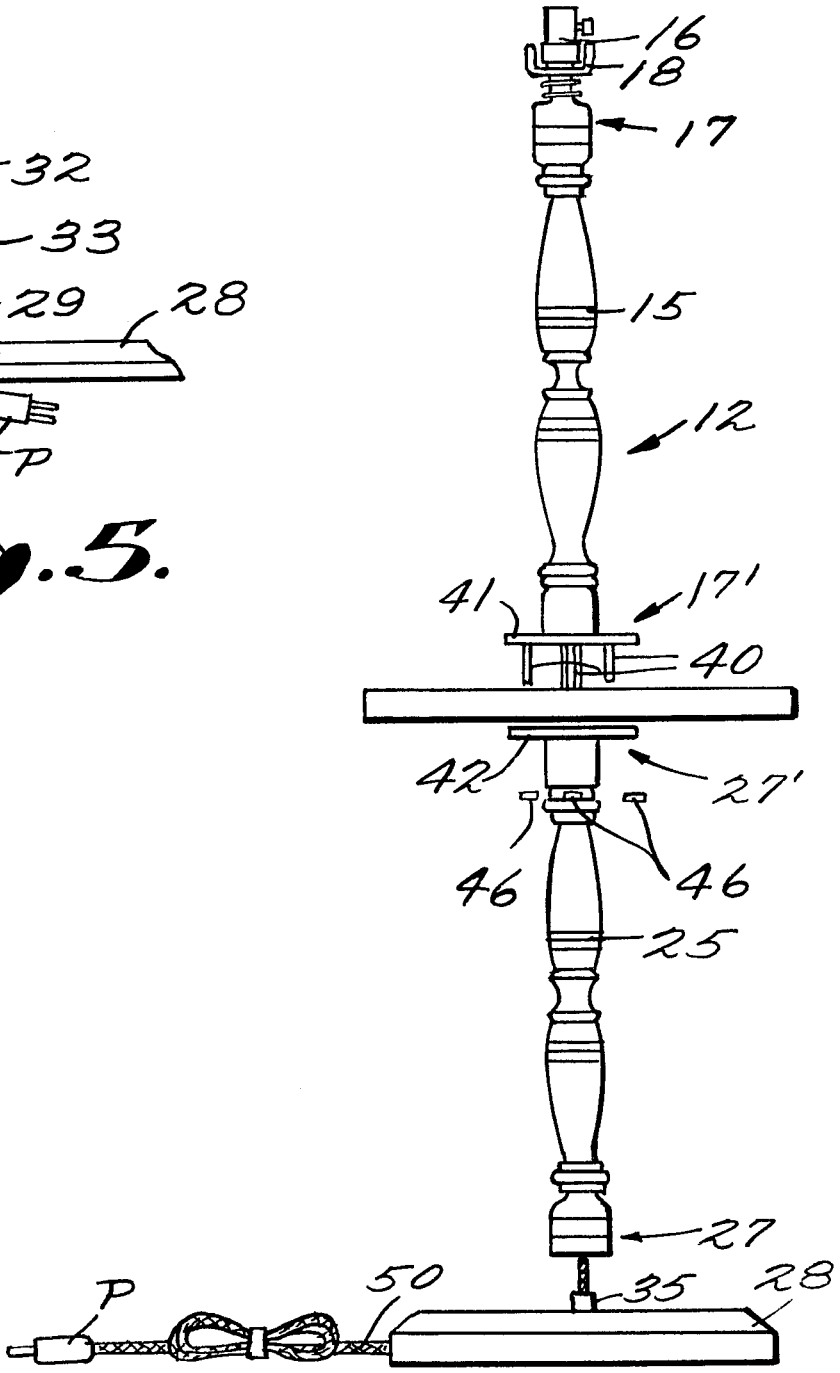

KNOCK-DOWN FLOOR LAMP

BACKGROUND AND SUMMARY OF THE INVENTION

There have been several proposals for knock-down floor lamps, which lamps are shipped in an unassembled position and then are assembled by the consumer. One such exemplary proposal is disclosed in U.S. Pat. No. 3,745,331. In general, prior knock-down floor lamps have had a number of drawbacks associated therewith.

One of the most common drawbacks with prior art knock-down floor lamps is that because of the knock-down configuration thereof they are not prewired, but must be wired by the ultimate consumer, who often is a non-professional. This can pose certain safety and fire hazards, and because of this knock-down lamps are not prewired cannot gain Underwriters Laboratories (U.L.) approval. Another common drawback associated with prior art knock-down floor lamps is that normally the lamp turnings are connected together by screw threaded components so that a rotational movement of one turning with respect to another is necessary. Especially when the turnings are made of wood, there is a tendency for such relative rotational movement to twist wiring extending through the turnings. Also, such wood screw-threaded couplings have a tendency to loosen with age and use, adversely affecting the stability of the assembled lamp. Further problems are encountered with damage to the unassembled components during shipping because of inability to properly position the components with respect to each other, and/or excessively large package volume being taken up by the components due to inability of properly positioning them relative to each other.

The problem of relying upon the ultimate consumer to effect wiring is accentuated since U.L. requirements now specify that electrical products must be wired with a predefined electrical polarity since all new homes are wired with such electrical polarity. New plugs are thus required with one plug prong larger than the other so that an appliance cannot be plugged into a home wall socket unless the proper polarity concurence is provided between the appliance and the home wiring.

According to the present invention, all of the above-mentioned drawbacks are avoided. According to the present invention a knock-down floor lamp can be shipped prewired in an unassembled condition, with the electrical polarity set at the factory. The lamp components are packaged together in a layering arrangement that minimizes damage and assures that the minimum packing volume is taken up by the components. In fact, the lampshade may readily be packaged in the same compartment with the lamp components. The lamp turnings may be connected together without requiring any relative rotational movement therebetween, the interconnection between the turning providing stability in use and over time.

According to the present invention an unassembled prewired lamp is disposed in a package and is adapted to be assembled into a complete lamp. The lamp includes a first elongated tubular turning having a socket formed at a first end thereof; a second elongated tubular turning; a base having an electrical cord passageway formed therein; means formed with the base and at a first end of the second turning for operatively releasably attaching the base and the second turning together; and means formed at a second end of the first turning and a second end of the second turning for releasably fastening the turnings together. An electrical cord is operatively electrically connected to the socket at a first end thereof and extends through the first and second turnings and the electrical cord passageway in the base, being movable with respect to the turnings and the base. The cord has a plug at a second end thereof, the plug being sized with respect to the base passageway so that it cannot be pulled through the passageway. The cord is significantly longer than the sum of the lengths of the turnings and the base passageway.

Preferably a tray is adapted to be disposed between the turnings, and the turnings can be connected together with a tray therebetween without requiring rotational movement of one turning with respect to the other. Preferably such fastening means include a plate having a plurality of threaded rods extending therefrom generally in the direction of elongation of the first turning and attached to the first turning, bores formed in the tray corresponding to the threaded rods, and a plate attached to the second turning having openings formed therein to receive the threaded rods. Nuts are attached to the ends of the threaded rods once passed through the tray and the second plate.

The lamp components are packaged together in a quadrate carton in a layering arrangement. The turnings are disposed on top with the direction of elongation thereof parallel to sheet separators utilized in the carton, and disposed along the diagonal of the carton. Then a first sheet separator is provided, then the tray, then a second sheet separator, and then the base. The electrical cord passes from the second end of the first turning around the first sheet separator to and through the tray, around the first sheet separator to the second turning second end, from the second turning first end around the first and second sheet separators to the base, and through the cord receiving base passageway. A shrink film plastic envelope encompasses the components and sheet separators, and is operatively attached to the carton bottom with hot melt adhesive or the like. A lampshade is disposed in the carton sandwiched between two sheet separators with packing tape or the like holding the sheet separators sandwiching the lampshade together. A sheet of foam plastic may be wrapped around at least one of the turnings to prevent the turnings from banging into each and marring the finish thereof.

It is the primary object of the present invention to provide an improved knock-down lamp that may be readily shipped and assembled. This and other objects of the invention will become clear from an inspection of the detailed description of the invention, and from the appended claims.

BRIEF DESCRIPTION OF THE DRAWINGS

FIG. 5 is a detail view, partly in cross-section and partly in elevation, of exemplary connecting means between the base and second turning, according to the present invention; and FIG. 6 is a side exploded view of the lamp according to the present invention generally in the assembled condition.

DETAILED DESCRIPTION OF THE DRAWINGS

Figure 1:
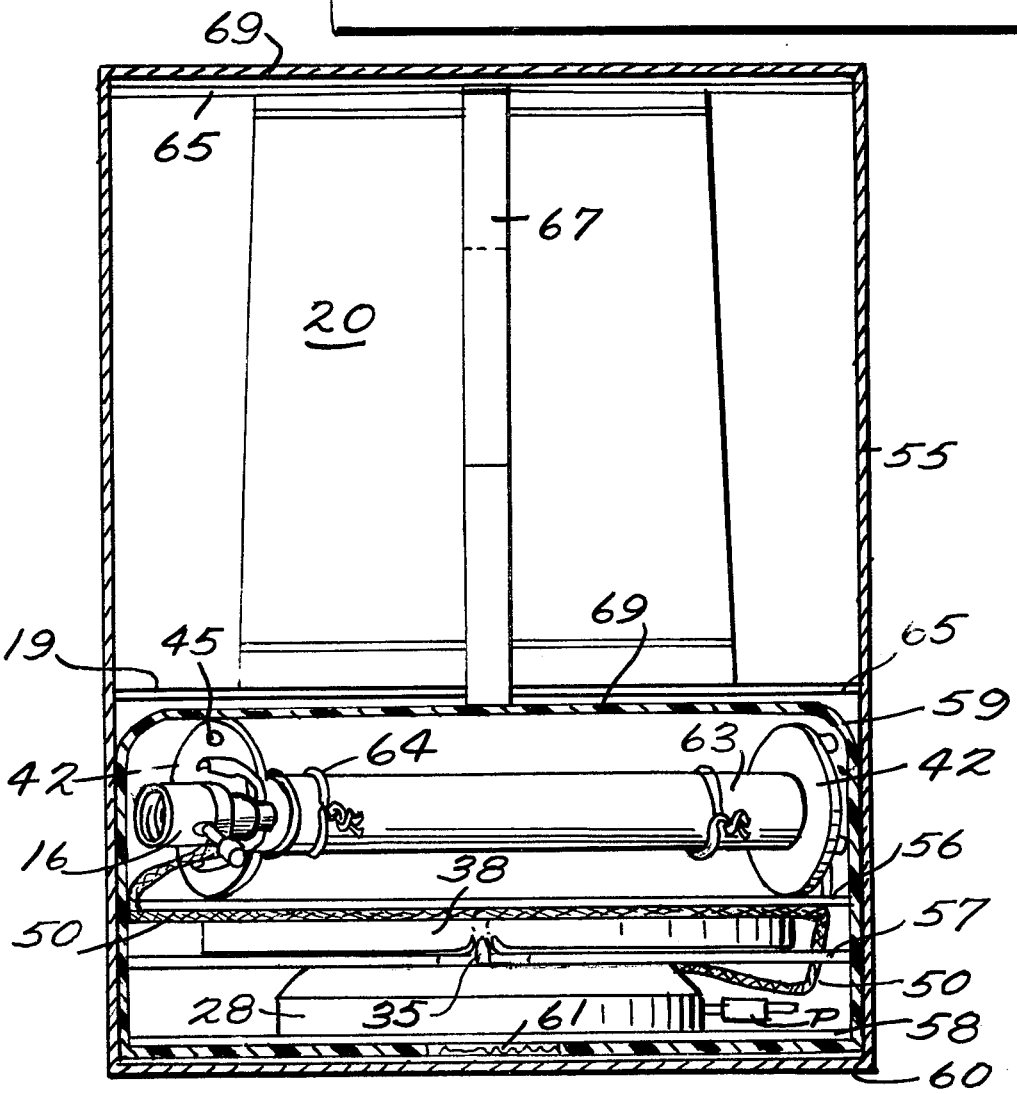
FIG. 1 is a side view partly in cross-section and partly in elevation of an unassembled prewired lamp according to the present invention packaged for shipment.

A knock-down lamp package according to the present invention is shown generally at 10 in FIG. 1, the lamp disposed in the package being capable of assembly into a floor lamp, as indicated generally at 12 in FIG. 6. The lamp includes a first elongated tubular turning 15 having a conventional socket 16 formed at a first end 17 thereof. The socket 16 normally will have a harp portion 18 attached thereto, for cooperation with a conventional detachable upper harp portion 19 (see FIG. 1). In use, the upper harp portion 19 is received by the lower harp portion 18 and is attached to a conventional spider in a conventional lampshade 20. The first turning 15 also has a second end 17' thereof.

The lamp 12 further includes a second elongated tubular turning 25 having a first end 27 adapted to be connected to a base 28 and a second end 27' adapted to be operatively connected to the first turning 15. The base 28 includes an electrical cord receiving passageway 29 (see FIG. 5 in particular) formed therein. Preferably tray 30 also is provided, adapted to be connected between the turnings 15, 25.

The turnings 15, 25, the base 28 and the tray 30 preferably are made of wood.

Means are formed with the base 28 and at the first end 27 of the second turning 25 for operatively releaseably attaching the base 28 and second turning 25 together. A preferred form of such means is shown most clearly in FIG. 5, and includes an exteriorly threaded tubular component 32 attached in the recess 33 formed in the end 27 of turning 25, and communicating with the tubular passageway in the turning 25. An interiorly threaded tubular component 35 is attached to the base 28 and stands proud of the base, the tubular connector 35 communicating with the electrical cord passageway 29 formed in the base 28.

The lamp 12 further includes means formed at the end 17' of the turning 15, and the end 27' of the turning 25 for releasably fastening the turnings 15, 25 together without requiring rotational movement of one turning with respect to the other; and with the tray 30 sandwiched between the turnings 15, 25. A preferred form of such releasable fastening means is illustrated most clearly in FIGS. 4 and 6 and includes a plurality of fasteners 40 extending from a first plate 41 attached to end 17' of turning 15, and extending generally parallel to the direction of elongation of the first turning 15; a second plate 42 formed at the end 27' of turning 25 and including means to operatively receive the fasteners 40; and a plurality of through-extending bores 43 (see FIG. 3) formed in the tray 30 to allow passage of the fasteners 40 therethrough. Preferably the fasteners 40 are screw threaded rods which pass through the bores 43 and cooperating openings 45 (see FIG. 4) formed in the plate 42, nuts 46 (see FIG. 6) being threaded over the rods 40 to hold the components together. In addition to allowing ready assembly of the turnings 15, 25 together without relative rotation therebetween, the fastening means 40, 41, 42, etc. provides a strong stable connection which does not loosen with age and use.

An electrical cord 50 is provided which prewires the lamp 12. Electrical cord 50 is operatively electrically connected at the first end thereof to the socket 16, the proper electrical polarity being provided during prewiring. A plug P is formed at the other end of the wire 15, the plug P having one prong larger than the other to correspond to conventional new-home electrical polarity wiring. The cord 50 extends through the first turning 15, through the central bore 52 (see FIG. 3) of the tray 30, through the second turning 25, and through the passageway 29 in the base 28. The plug P is sized with respect to the base passageway 29 so that it cannot be pulled through the passageway 29 and the cord 50 is significantly longer (see FIG. 6) than the sum of the lengths of the turnings 15, 25 and the base passageway 29. The cord 50 is moveable with respect to the turnings 15, 25, the tray 30 and the base 28.

Figure 2:
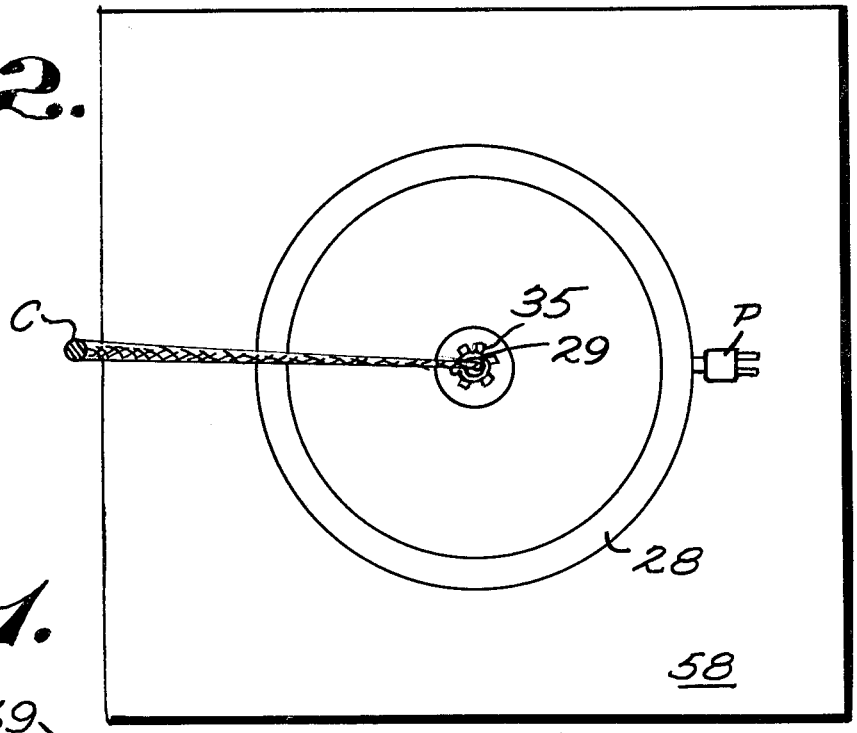
FIG. 2 is a top plan view of the bottom layer of lamp components in the package of FIG. 1.
Figure 3:
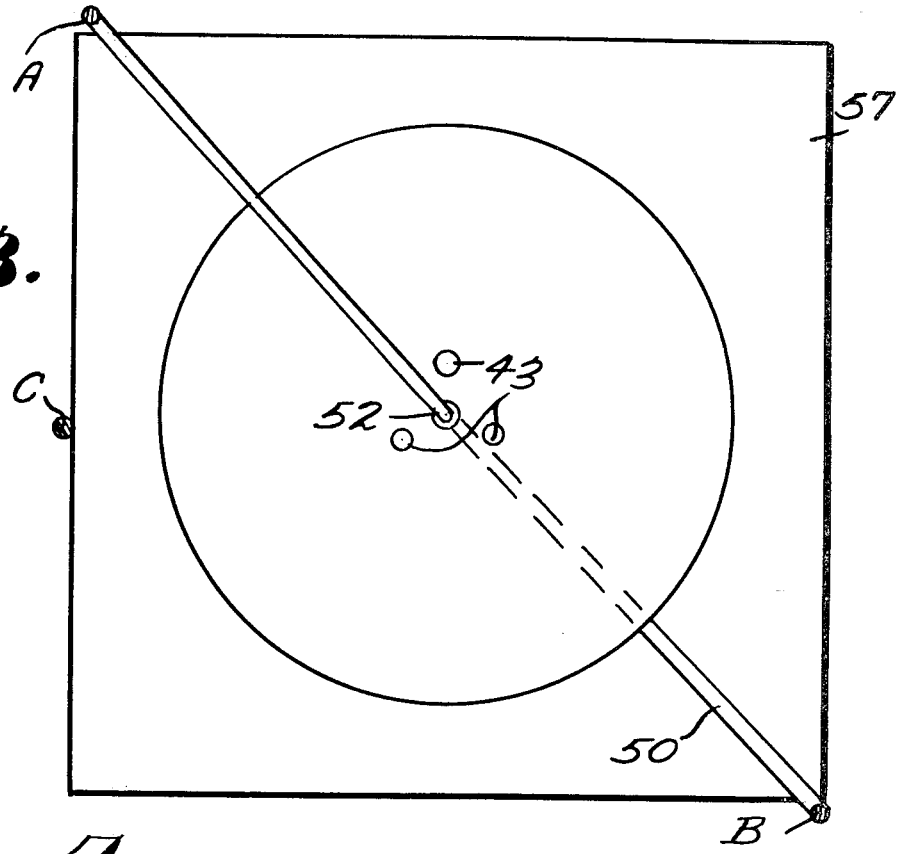
FIG. 3 is a top plan view of the middle layer of components in the package of FIG. 1.
Figure 4:
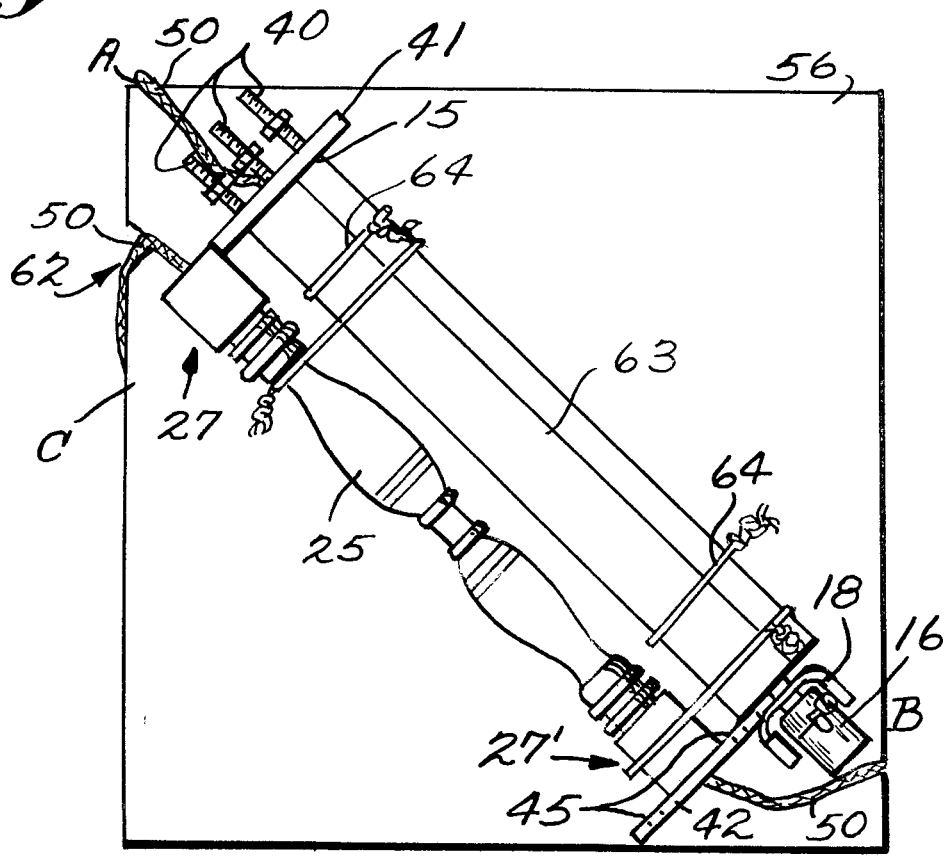
FIG. 4 is a top plan view of the top layer of components of the package of FIG. 1.

The lamp components are shown packed for shipping in a package 10 in FIG. 1, providing a layered arrangement, the layers being illustrated more clearly in FIGS. 2 through 4. The package includes a quadrate exterior cardboard carton 55 having a diagonal, and at least two cardboard sheet separators 56, 57, with a third sheet separator 58 preferably being provided.

The lamp components are layered in the carton 55, an envelope 59 of shrink film transparent plastic, or like means, being provided for maintaining the lamp components and the sheet separators 56 through 58 together.

The layering of the lamp components provides the turnings 15, 25 disposed on top with the direction of elongation thereof parallel to the sheet separators and disposed along the diagonal of carton 55 (see FIG. 4 in particular, the sheet 56 having substantially the same exterior perimeter configuration and size as the interior perimeter configuration and size of the carton 55). Then the first sheet separator 56 is provided, then the tray 30, then the second sheet separator 57, then the base 28 and then the third sheet separator 58, with the envelope 59 encompassing them all and maintaining them together. The envelope 59 and/or the third sheet separator 58 are then affixed to the bottom 60 of the carton 55 as via a hot melt adhesive 61 (see FIG. 1).

The electrical cord 50 passes between the various components and around the various sheet layers. The path that the cord 50 takes is seen most clearly by inspecting FIGS. 2 through 4. The cord 50 extends from the second end 17' of the first turning 15, and may be looped one or more times around the turning 15 (see FIG. 4) and then passes generally around the first sheet separator 56 to and through opening 52 in tray 30 (compare "As" in FIGS. 3 and 4). It then passes generally around the first separator 56 to the second turning 25 second end 27' (compare "Bs" in FIGS. 3 and 4), then passes through the tubular turning 25 generally around both the first and second separators 56, 57 to the base (compare "Cs" in FIGS. 2 through 4) then passing through tubular connector 25 into passageway 29 and base 28, and passing out of the base 28 and having the end thereof formed in plug P. If desired, the cord 50 may be loosely held in various relative positions with respect to the separators 56 through 58, as by the slit 62 in separator 56 (see FIG. 4) which frictionally engages the cord 50.

Preferably a mar-preventing packaging material is disposed between the first and second turnings 15, 25, such as a sheet of foam plastic 63 wrapped around at least one of the turnings (15), and held in place by strings 64 or the like.

With the lamp components packaged in the layered arrangement indicated in FIG. 1, the carton 55 also may readily contain the lampshade 20 and upper harp portion 19. The lampshade 20 is sandwiched between a pair of cardboard sheets 65, the sheets 65 being maintained in engagement with the ends of the lampshade 20 by a piece of shipping tape 67 wrapped around the sheets 65. The upper harp portion 19 may be fastened by a piece of tape or the like to one of the sheets 65 if desired. The lampshade 20 and cardboard sheet 65 (which have substantially the same exterior perimeter configuration and dimensions as the interior perimeter configuration and dimensions of the carton 55) are then placed in the carton 55 on top of the lamp components. The top 69 of the carton 55 is then sealed in a conventional manner.

The assembly according to the present invention having been described, the manner of packaging and then assembly thereof will now be set forth:

An electrical cord 50 of sufficient length is run through the base passageway 29, turning 25, tray 30, and turning 15 and is wired with proper polarity to the socket 16, with the socket 16 then being rigidly attached to the turning 15. With a great deal of slack in the cord 50, the foam plastic 63 is then wrapped around the turning 15, the turning 15 is disposed diagonally on the separator 56, the turning 25 is disposed diagonally on the sheet 56, then tray 30 is disposed on the separator 57, and the base 28 is disposed on the separator 58, with the cord 50 extending around the separator sheets 56 and 57 as illustrated in FIGS. 1 through 4. The layered arrangement is then enveloped by a sheet of shrink film plastic 59, it is exposed to heat to shrink the film around the layered components, and the full envelope is then attached by hot melt adhesive 61 to the bottom 60 of a carton 55. The lampshade 20 is sandwiched between the cardboard sheets 65 with the tape 67 and the lampshade disposed in the carton 55, with the carton top 69 then being closed and sealed.

Once the package 10 arrives at the ultimate consumer, the lampshade 20 is removed from the carton 55, the envelope 59 is removed and punctured; the foam wrap 63 is removed from the turning 15; and the sheets 56 through 58 are removed from between the lamp components, the lamp components then being laid out in a string. The exteriorly threaded tubular connector 39 of second turning 25 (see FIG. 5) is then placed in operative relationship with the interiorly threaded metal tubular connector 35 attached to the base 28, and the turning 25 is rotated with respect to the base 28 so that the connectors 32, 35 fasten the turning 25 and base 28 together. Then the tray 30 is placed on top of the plate 42 with the holes 43, 45 in registry, and the threaded rods 40 of plate 41 are then passed through the openings 43, 45 and are secured in place with nuts 46. The cord 50 is then pulled at the exit of passageway 29 from base 28 to take up the slack, the assembled lamp 12 (see FIG. 6) then being provided. The upper harp portion 19 is connected to the shade 20 and the lower harp portion 18 of the socket 16 in conventional manner to provide the final lamp.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. An unassembled prewired lamp disposed in a package and adapted to be assembled into a lamp, said lamp comprising a first elongated tubular turning having a socket formed at a first end thereof;

a second elongated tubular turning;

a base having an electrical cord passageway formed therein;

means formed with said base and at a first end of said second turning for operatively releasably attaching said base and second turning together;

means formed at a second end of said first turning and a second end of said second turning for releasably fastening said turnings together; and an electrical cord operatively electrically connected to said socket at a first end thereof and extending through said first and second turnings and said electrical cord passageway in said base and being movable with respect to said turnings and base, and having a plug at a second end thereof; said plug being sized with respect to said base passageway so that it cannot be pulled through said passageway; and said cord being significantly longer than the sum of the lengths of said turnings and said base passageway.

2. An unassembled lamp as recited in claim 1 wherein said means for releasably fastening said turnings together comprise means for fastening said turnings together without requiring rotational movement of one turning with respect to the other.

3. An unassembled lamp as recited in claim 2 further comprising a tray having a central opening formed therein, said means for releasably fastening said turnings together including means for attaching said tray between said turnings; said electrical cord passing through said tray opening from said first turning to said second turning, and being movable with respect to said tray.

4. An unassembled lamp as recited in claim 3 wherein said means for releasably fastening said turnings together comprises a first plate formed on the second end of one of said turnings and having a plurality of fasteners extending therefrom parallel to the direction of elongation of said turning; a second plate formed on the second end of the other of said turnings and including means to operatively receive said fasteners therein; and a plurality of bores formed in said tray for allowing passage of said fasteners therethrough to the other of said turnings.

5. An unassembled lamp as recited in claim 4 wherein said fasteners are screw threaded rods and wherein said means of said second plate for operatively receiving said rods comprises a plurality of unthreaded bores; and wherein a plurality of nuts are provided for operative attachment to said threaded rods.

6. An unassembled lamp as recited in claim 5 wherein said first plate is connected to said first turning, and said second plate is connected to said second turning, and wherein at least three threaded rods are provided.

7. An unassembled lamp as recited in claims 1 or 6 wherein said means formed with said base and said second turning for operatively releasably connecting them together comprises an exteriorly threaded metal tubular connector formed recessed in said first end of said second turning, and an interiorly threaded metal tubular connector standing proud from said base; and wherein said electrical cord passes through said tubular connectors and is movable with respect thereto.

8. An unassembled lamp as recited in claim 3 disposed in a package comprising a quadrate exterior carton having a diagonal, and at least two sheet separators; said sheet separators and the lamp components being layered in said carton with said turnings being disposed on top with the direction of elongation thereof parallel to said sheet separators and disposed along the carton diagonal, then a first sheet separator, then said tray, then a second sheet separator, and then said base; said electrical cord passing from said second end of said first turning generally around said first sheet separator to and through said tray, then generally around said first separator to said second turning second end, then from said second turning first end generally around said first and second sheet separators to said base and through said cord receiving base passageway.

9. A package as recited in claim 8 further comprising means for maintaining said sheet separators and lamp components together within said carton.

10. A package as recited in claim 9 wherein said maintaining means comprises an envelope of shrink film plastic.

11. A package as recited in claim 9 further comprising means for affixing said maintaining means to the bottom of said carton.

12. A package as recited in claim 11 further comprising a lamp shade disposed in said carton sandwiched between two sheet separators, and means for maintaining said lamp shade between said sheet separators; and wherein said socket includes a lower harp portion; and further comprising an upper harp portion disposed in said carton, detached from said lower harp portion.

13. A package as recited in claim 8 further comprising mar-preventing packaging material disposed between said first and second turnings.

14. A package as recited in claim 13 wherein said mar-preventing packaging material comprises a sheet of foam plastic wrapped around at least one of said turnings.

15. A knock-down lamp comprising a first elongated wood tubular turning having a socket formed at a first end thereof;

a second elongated wood tubular turning;

a base;

means formed with said base and a first end of said second turning for operatively releasably attaching said base and second turning together;

a tray; and means for operatively releasably attaching a second end of said first turning, a second end of said first turning, and said tray together, said means comprising a first metal plate formed on the second end of one of said turnings and having a plurality of fasteners extending therefrom parallel to the direction of elongation of said turning; a second metal plate formed on the second end of the other turning and including means to operatively receive said fasteners therein; and a plurality of bores formed in said tray for allowing passage of said fasteners therethrough to the other of said turnings.

16. A knock-down lamp recited in claim 15 wherein said fasteners are screw threaded rods and wherein said means of said second plate for operatively receiving said rods comprises a plurality of unthreaded bores; and wherein a plurality of nuts are provided for operative attachment to said threaded rods.

17. A knock-down lamp as recited in claim 16 wherein said first plate is connected to said first turning, and said second plate is connected to said second turning, and wherein at least three threaded rods are provided.

18. A knock-down lamp as recited in claim 17 wherein said means formed with said base and said second turning for operatively releasably connecting them together comprises an exteriorly threaded metal tubular connector formed recessed in said first end of said second turning, and an interiorly threaded metal tubular connector standing proud from said base.

* * * * *